US012285665B2

(12) United States Patent
Zhang

(10) Patent No.: US 12,285,665 B2
(45) Date of Patent: Apr. 29, 2025

(54) MAGNETIC POSITIONING STAND FOR GOLF BAG

(71) Applicant: DONGGUAN YAOYU PLASTIC HARDWARE PRODUCT CO., LTD, Dongguan (CN)

(72) Inventor: Evan Zhang, Dongguan (CN)

(73) Assignee: DONGGUAN YAOYU PLASTIC HARDWARE PRODUCT CO., LTD, Dongguan (CN)

( * ) Notice: Subject to any disclaimer, the term of this patent is extended or adjusted under 35 U.S.C. 154(b) by 123 days.

(21) Appl. No.: 18/168,587

(22) Filed: Feb. 14, 2023

(65) Prior Publication Data

US 2024/0207704 A1 Jun. 27, 2024

(51) Int. Cl.
*A63B 55/50* (2015.01)

(52) U.S. Cl.
CPC ..... *A63B 55/50* (2015.10)

(58) Field of Classification Search
CPC ..... A63B 55/50
See application file for complete search history.

(56) References Cited

U.S. PATENT DOCUMENTS 2,765,550 A * 10/1956 De Angelis ..... D06F 75/34 38/92
3,276,804 A * 10/1966 Heppner ..... E05C 19/16 292/251.5
5,133,581 A * 7/1992 Coleman ..... E05C 19/166 292/DIG. 53
6,435,345 B1 * 8/2002 Wang ..... A63B 55/57 206/315.7
6,766,905 B1 * 7/2004 Chang ..... A63B 55/53 206/315.6
12,053,681 B2 * 8/2024 Pacha ..... A63B 55/57
2009/0212174 A1 * 8/2009 Pratt ..... A63B 55/57 248/97

FOREIGN PATENT DOCUMENTS

CN 209503608 U 10/2019
CN 210771275 U 6/2020
CN 213482837 U 6/2021
CN 218572771 U * 3/2023

* cited by examiner

*Primary Examiner* — Tri M Mai
(74) *Attorney, Agent, or Firm* — Nitin Kaushik

(57) ABSTRACT

The present invention relates to the technical field of sporting goods and particularly relates to a magnetic positioning stand for a golf bag. It is mainly composed of a chassis, support rods, a head frame, support legs, support steel wires, and a bag body; the chassis and the head frame constitute a cylinder structure with an open upper end and a closed lower end via the support rods; one end of the support steel wire is hinged at the end of a large chassis, and the other end is connected to the middle section of the support leg; the top of the support leg is hinged at the outside of the head frame in the same direction as the support steel wire is hinged at the end of the large chassis; the bag body surrounds the periphery between the chassis and the head frame.

2 Claims, 10 Drawing Sheets

MAGNETIC POSITIONING STAND FOR GOLF BAG

CROSS-REFERENCE TO RELATED APPLICATIONS

The application claims priority to Chinese patent application No. 2022234272752, filed on Dec. 22, 2022, the entire contents of which are incorporated herein by reference.

TECHNICAL FIELD

The present invention relates to the technical field of sporting goods and particularly relates to a magnetic positioning stand for a golf bag.

BACKGROUND

With people's demand for fitness and the wide range of sports hobbies, golf is becoming more and more popular with the majority of sportsmen because of its moderate amount of exercise, not fierce antagonism, challenging oneself, and the full contact between sportsmen and nature.

In the course of sports, due to the hitting distance and the choice of the fairway, a sportsman needs to carry a plurality of golf clubs to play golf. A plurality of golf clubs are contained in a golf bag. In order to facilitate hitting golf balls on various occasions, a sportsman needs to take out the corresponding golf clubs from the golf bag. Therefore, in order to facilitate the sportsman taking the golf clubs from the golf bag, manufacturers design the golf bags to be tiltable, as shown in FIGS. 1-3. That is, the golf bag is mainly composed of a chassis 1, support rods 2, and a head frame 3. The chassis 1 and the head frame 3 constitute a cylinder structure with an open upper end and a closed lower end via the support rods 2 (an outer bag body is not shown in the figures). Various golf clubs for hitting the balls are received between the grills in different categories via grills on the head frame 3. When it is necessary to take out the corresponding golf club from the golf bag, the sportsman can push the head frame 3 of the upright golf bag forward. The chassis 1 is constituted of a large chassis 11 and a small chassis 12. The large chassis 1 and the small chassis 12 are connected via a hinge structure. Under the action of an external force, the small chassis 12 rotates about the hinge point via the hinge structure, namely, the rear end of the bottom of the golf bag rises. The lower ends of the three support rods 2 are all fixed on the small chassis 12, and the lower ends of the support rods 2 follow the rotation of the small chassis 12 to tilt. The upper ends of the support rods 2 are all fixed at the bottom of the head frame 3, and the head frame 3 also tilts with the tilting of the support rods 2. At the same time, one end of a support steel wire 5 is hinged to an end of the large chassis 11, and the other end is connected to the middle section of the support leg 4. The top of the support leg 4 is hinged at the outside of the head frame 3 in the same direction as the support steel wire 5 is hinged at end of the large chassis 11. The tilting of the head frame 3 enables the support steel wires 5 to also swing around the hinge point on the large chassis 11. The other end of the support steel wire 5 enables the support leg 4 to swing around the hinge point on the outside of the head frame 3, so as to open the support legs 4. Thus, the three points constituted by the bottom ends of the two support legs 4 and the bottom of the large chassis 11 support the golf bag on the ground in an inclined posture, so as to facilitate the sportsman to take the golf club from the golf bag. When the use is completed, the head frame 3 is pulled backward, and the support steel wires 5 are retracted by a reverse movement so that the two support legs 4 are folded and abut against the outside of the body of the golf bag.

However, during the use of such a structure, the phenomenon that the support legs 4 automatically open when carrying the golf bag on the back often occurs, which brings great discomfort and inconvenience to the sportsman. The reason for this is that all the lower ends of the three support rods 2 are fixed on the small chassis 12, and there is no support rod 2 connection between the large chassis 11 and the head frame 3; only the support steel wires 5 and the support legs 4 are respectively connected with the large chassis 11 and the head frame 3, and the connection between the support steel wire 5 and the support leg 4 is a movable connection. When a sportsman carries the golf bag on his back, the back applies a force to the golf bag, which is equivalent to applying pressure to the bag body in the direction of the support rods 2 located on two sides of the golf bag. In addition, since golf clubs are received in the golf bag, the heads of the golf clubs all protrude out of the golf bag, so that the center of gravity of the golf bag on the tilted back shifts upward, and the upper center of gravity presses the side of the head frame 3 close to the support leg 4, which is equivalent to applying the head frame 3 an external force for pushing. When this external force is slightly greater than or equal to the external force applied by the above-mentioned sportsman, the support legs 4 will be ejected out by the support steel wires 5, resulting in the defect that the support legs 4 naturally opens.

SUMMARY

The purpose of the present invention is to overcome the above-mentioned deficiencies in the prior art, and to provide a magnetic positioning foot stand for a golf bag.

The utility model is realized by the following technical solutions: A magnetic positioning stand for a golf bag, mainly composed of a chassis, a support rod, a head frame, support legs, support steel wires and a bag body, wherein the chassis and the head frame constitute a cylinder structure with an open upper end and a closed lower end via the support rods; one end of the support steel wire is hinged at the end of the large chassis, the other end is connected to the middle section of the support leg; the top of the support leg is hinged at the outside of the head frame in the same direction as the support steel wire is hinged at the end of the large chassis; the bag body surrounds the periphery between the chassis and the head frame: the other end of the support leg is fixedly provided with a foot pad; an attracted device is provided on the foot pad of the support leg, and an attracting device is provided at a position where the support leg is folded and abutted against the bag body; when the two support legs are folded and abutted against the outside of the bag body of the golf bag, the attracted device provided on the foot pad and the attracting device on the bag body are mutually attracted and fixed.

The attracted device is constituted of a groove on the foot pad and a metal sheet; the groove on the foot pad is located on the side facing the bag body; the metal sheet is inserted and fixed in the groove; a projection portion of the metal sheet protrudes outside the groove.

The attracting device is fixed on the bag body; the attracting device is symmetrically provided with through grooves on both sides; a magnetic metal block is provided in the through groove; and a projection portion of the magnetic metal block protrudes outside the through groove and corresponds to the projection portion of the metal sheet.

Both sides of the through groove of the attracting device are provided with projections facing the attracted device; the recess formed by the projections can just receive the attracted device therebetween.

The metal sheets or magnetic metal blocks are provided interchangeably.

The utility model uses a structural method of direct attraction of a metal block so that the support legs are firmly attracted to the bag body of the golf bag when they are not in use, fundamentally solving the problem of the support legs being naturally open when a sportsman rides with the golf bag on his back.

DETAILED DESCRIPTION OF THE EMBODIMENTS

Figure 1:
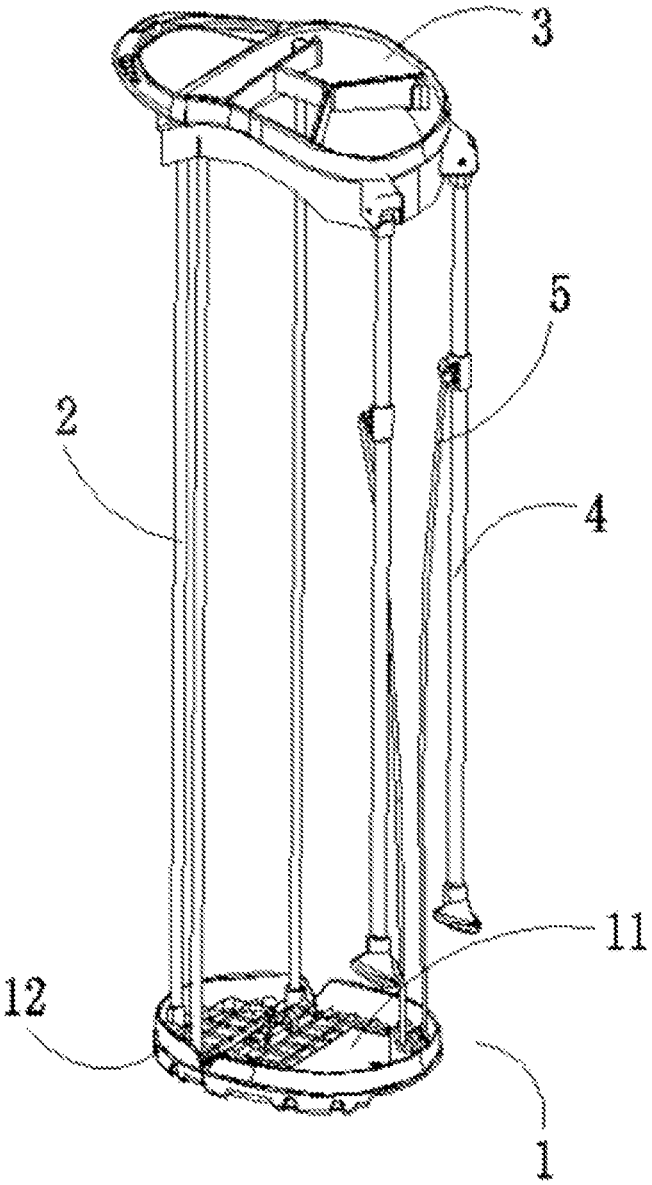
FIG. 1 is a perspective view of the prior art.
Figure 2:
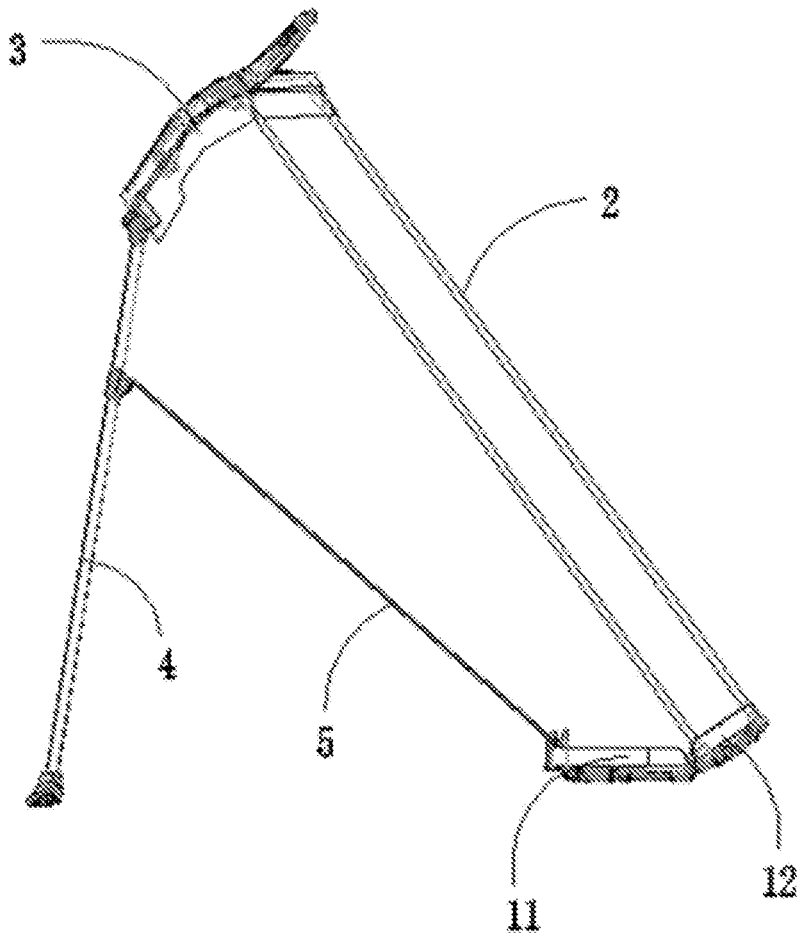
FIG. 2 is one diagram showing the state of use of the prior art.
Figure 3:
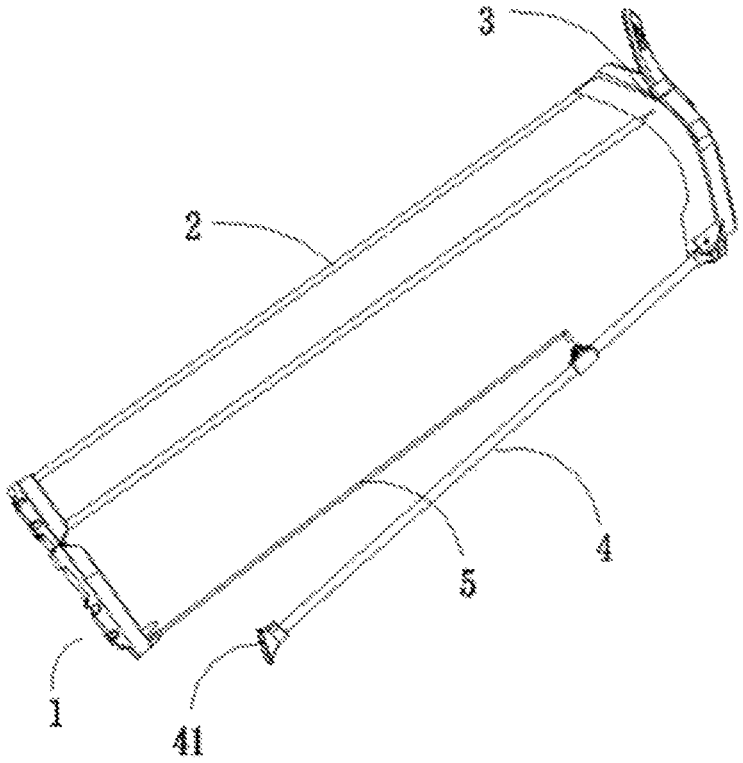
FIG. 3 is a second diagram showing the state of use of the prior art.
Figure 4:
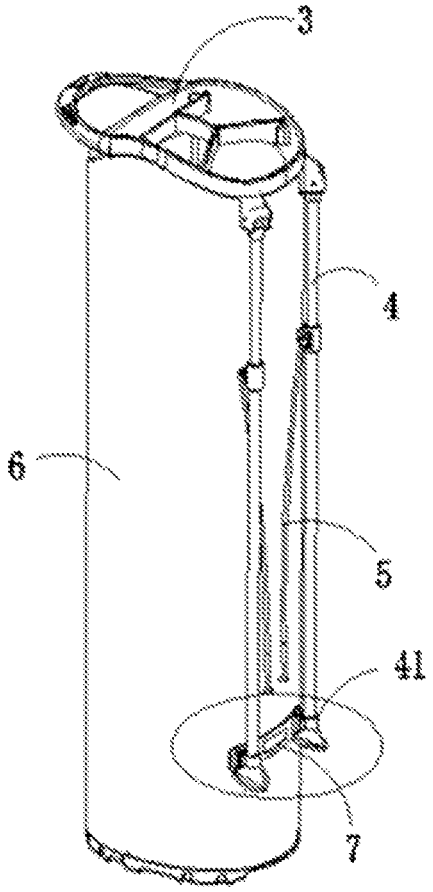
FIG. 4 is a perspective view of the present invention.
Figure 5:
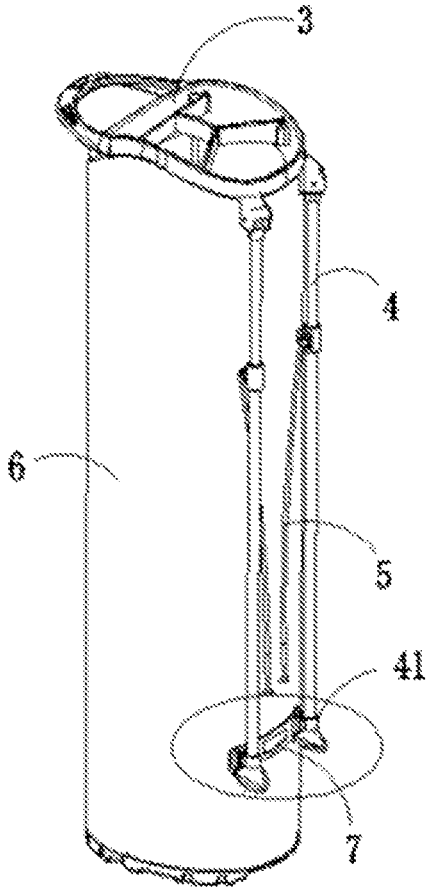
FIG. 5 is a side view of the present invention.
Figure 6:
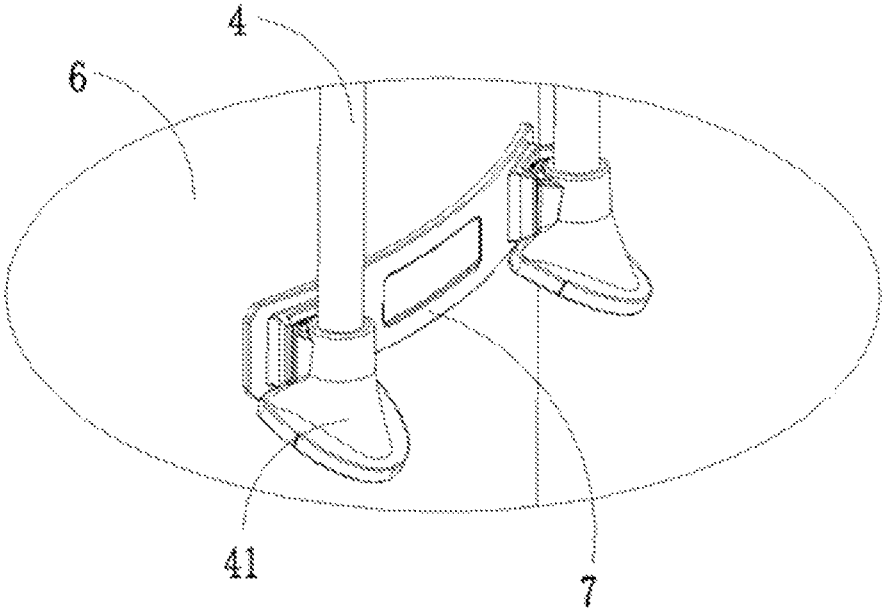
FIG. 6 is an enlarged view of FIG. 4.
Figure 7:
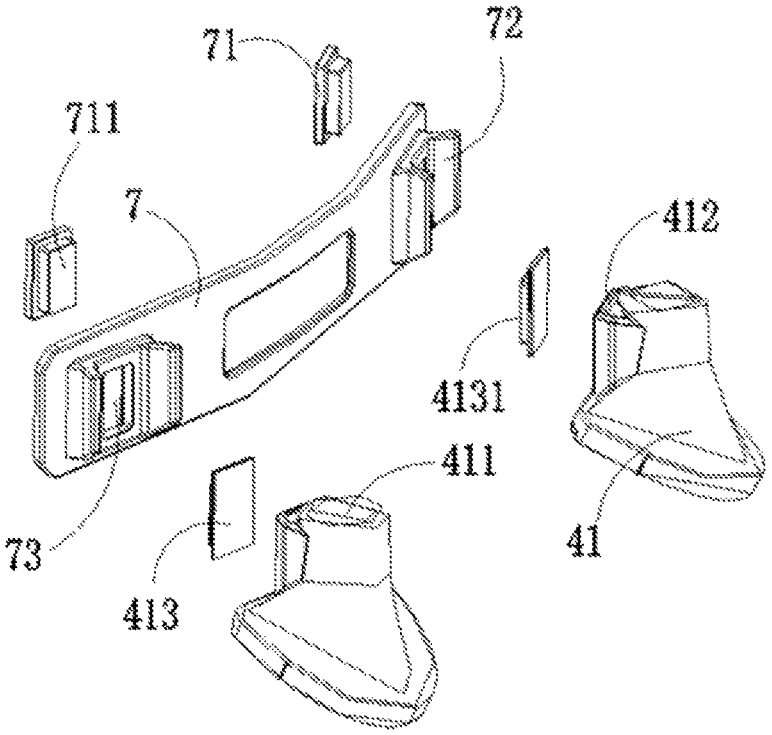
FIG. 7 is a perspective exploded view of the present invention.
Figure 8:
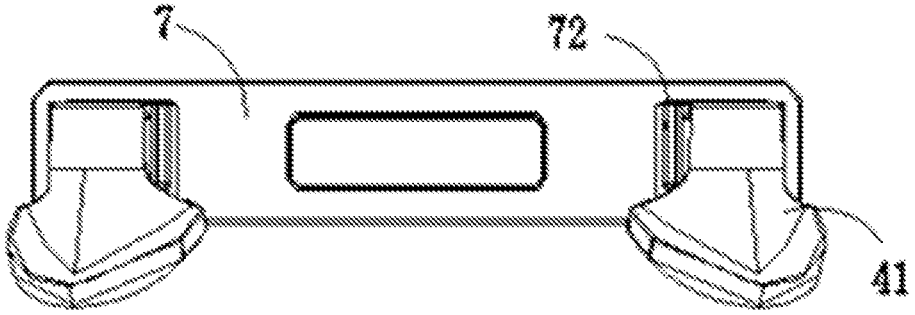
FIG. 8 is a front view of the present invention.
Figure 9:
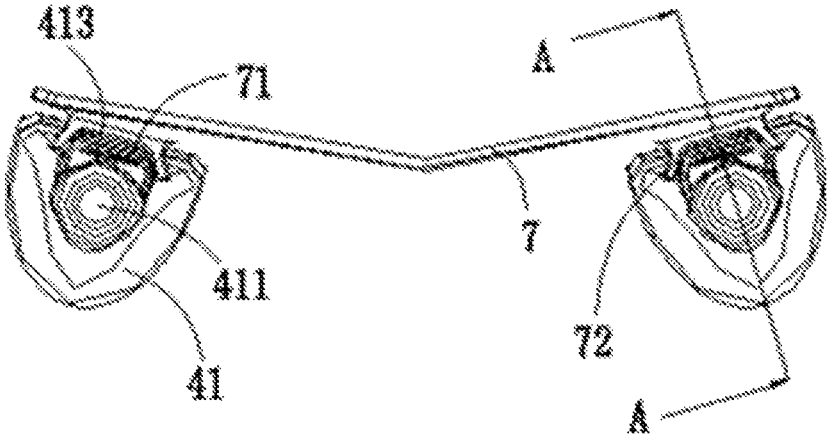
FIG. 9 is a top view of the present invention.
Figure 10:
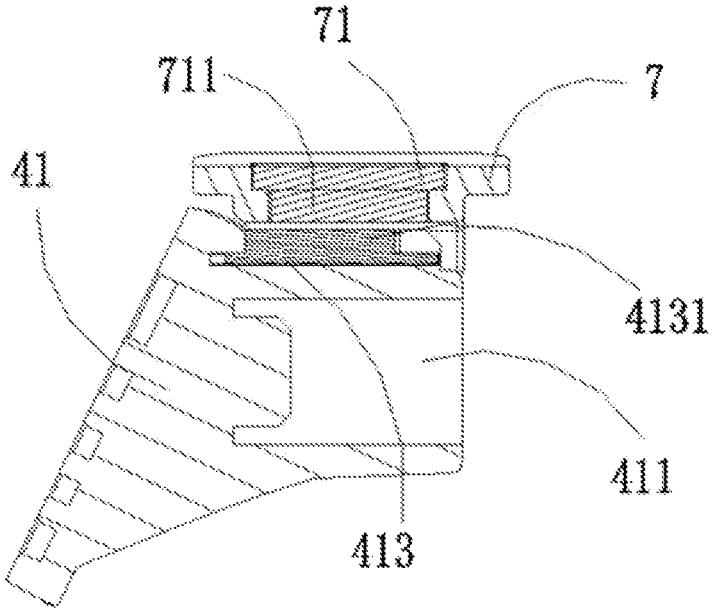
FIG. 10 is a sectional view A-A of FIG. 9.

With reference to FIGS. 4-10, a magnetic positioning stand for a golf bag is mainly composed of a chassis 1, support rods 2, a head frame 3, support legs 4, support steel wires 5, and a bag body 6. The chassis 1 and the head frame 3 constitute a cylinder structure with an open upper end and a closed lower end via the support rods 2. One end of the support steel wire 5 is hinged at the end of a large chassis 11, and the other end is connected to the middle section of the support leg 4. The top of the support leg 4 is hinged at the outside of the head frame 3 in the same direction as the support steel wire 5 is hinged at the end of the large chassis 11. The bag body 6 surrounds the periphery between the chassis 1 and the head frame 3. The other end of the support leg 4 is fixedly provided with a foot pad 41. An attracted device is provided on the foot pad 41 of the support leg 4, and an attracting device 7 is provided at a position where the support leg 4 is folded and abutted against the bag body 6. When the two support legs 4 are folded and abutted against the outside of the bag body of the golf bag, the attracted device provided on the foot pad 41 and the attracting device 7 on the bag body 6 are mutually attracted and fixed.

The attracted device is constituted of a groove 412 on the foot pad 41 and a metal sheet 413. The groove 412 on the foot pad 41 is located on the side facing the bag body 6. The metal sheet 413 is inserted and fixed in the groove 412. A projection portion 4131 of the metal sheet 413 protrudes out of the groove 412.

The attracting device 7 is fixed on the bag body 6. The attracting device 7 is symmetrically provided with through grooves 73 on both sides. A magnetic metal block 71 is provided in the through groove 73. A projection portion 711 of the magnetic metal block 71 protrudes outside the through groove 73 and corresponds to the projection portion 4131 of the metal sheet 413.

Both sides of the through groove 73 of the attracting device 7 are provided with projections 72 facing the attracted device. The recess formed by the projections 72 can just receive the attracted device therebetween.

The metal sheet 413 or the magnetic metal block 711 may be provided interchangeably.

When the utility model is applied, if the sportsman finishes the golf game, the support legs 4 are folded at the position abutting against of the bag body 6. When the sportsman rides with the golf bag on the back, since the attracted device provided on the foot pad 41 and the attracting device 7 on the bag body 6 are attracted and engaged with each other, the support legs 4 are firmly folded and attracted on one side of the bag body 6, thus fundamentally solving the problem that the support legs 4 will naturally open.

What is claimed is:

1. A magnetic positioning stand for a golf bag, composed of a chassis, support rods, a head frame, support legs, support steel wires and a bag body, wherein the chassis and the head frame constitute a cylinder structure with an open upper end and a closed lower end via the support rods; one end of the support steel wire is hinged at an end of the chassis, the other end of the support steel wire is connected to a middle section of the support leg; a top of the support leg is hinged at the outside of the head frame in the same direction as the support steel wire is hinged at the end of the chassis; the bag body surrounds the periphery between the chassis and the head frame; the other end of the support leg is fixedly provided with a foot pad; an attracted device is provided on the foot pad of the support leg, and an attracting device is provided at a position where the support leg is folded and abutted against the bag body; when two of the support legs are folded and abutted against the outside of the bag body of the golf bag, the attracted device provided on the foot pad and the attracting device on the bag body are mutually attracted and fixed, wherein the attracted device is constituted of a groove on the foot pad and a metal sheet; the groove on the foot pad is located on the side facing the bag body; the metal sheet is inserted and fixed in the groove; a projection portion of the metal sheet protrudes outside the groove, wherein the attracting device is fixed on the bag body; the attracting device is symmetrically provided with through grooves on both sides; a magnetic metal block is provided in the through groove; and a projection portion of the magnetic metal block protrudes outside the through groove and corresponds to the projection portion of the metal sheet, and wherein both sides of the through groove of the attracting device are provided with projections facing the attracted device; the recess formed by the projections can just receive the attracted device therebetween.

2. The magnetic positioning stand for a golf bag of claim 1, wherein the metal sheet and the magnetic metal block are provided interchangeably.

* * * * *